US006015655A

United States Patent [19]

Hagemann et al.

[11] Patent Number: 6,015,655

[45] Date of Patent: Jan. 18, 2000

[54] COLOR PHOTOGRAPHIC RECORDING MATERIAL

[75] Inventors: Jörg Hagemann; Werner Hoheisel, both of Köln, Germany

[73] Assignee: Agfa-Gevaert NV, Mortsel, Belgium

[21] Appl. No.: 09/350,344

[22] Filed: Jul. 14, 1999

[30] Foreign Application Priority Data

Jul. 22, 1998 [DE] Germany ..... 198 32 937

[51] Int. Cl.[7] ..... G03C 1/815

[52] U.S. Cl. ..... 430/512; 430/507; 430/510

[58] Field of Search ..... 430/512, 510, 430/507

[56] References Cited

U.S. PATENT DOCUMENTS 4,356,250 10/1982 Irani et al. ..... 430/216

5,252,424 10/1993 Sato et al. ..... 430/510

5,731,136 3/1998 Schmuck ..... 430/512

FOREIGN PATENT DOCUMENTS 736 800 3/1996 European Pat. Off. .

*Primary Examiner*—Richard L. Schilling

*Attorney, Agent, or Firm*—Connolly Bove Lodge & Hutz LLP

[57] ABSTRACT

A color photographic recording material comprising at least one light sensitive silver halide emulsion layer and optionally a light insensitive layer which is disposed nearer the source of light than is the light sensitive silver halide emulsion layer, wherein at least one of said layers contains particles of cerium(IV) oxide, zinc oxide or barium titanate with an average diameter <300 nm, is characterized by improved protection from UV light.

14 Claims, No Drawings

COLOR PHOTOGRAPHIC RECORDING MATERIAL

This invention relates to a colour photographic recording material which contains a new, significantly improved UV light absorber.

It is known that UV radiation, even that of an intensity which reaches the earth's surface from sunlight, has a harmful effect on many substances. Therefore, colour photographic materials always contain UV absorbers in order to impart stability to or to improve the stability of the image dyes which are present in the material after processing. Daylight which is rich in UV is capable of bleaching the image dyes.

Organic compounds which exhibit a molecular absorption band within the relevant wavelength range and which do not absorb in the visible spectral region have mostly been used hitherto as UV absorbers.

Examples of compounds which are normally used in photographic materials for the absorption of UV light include aryl-substituted benzotriazole compounds (U.S. Pat. No. 3,533,794, DE-A-42 29 233), 4-thiazolidone compounds (U.S. Pat. No. 314,794, U.S. Pat. No. 3,352,681), benzophenone compounds (JP-A-2784/71), cinnamic acid esters (U.S. Pat. No. 3,705,805, U.S. 3,707,375), butadiene compounds (U.S. Pat. No. 4,045,229), benzoxazole compounds (U.S. Pat. No. 3,700,455), aryl-substituted triazine compounds (DE-A-21 13 833, EP-A-520 938, EP-A-530 135, EP-A-531 258) and benzoylthiophene compounds (GB-A-973 919, EP-A-521 823). Couplers or polymers are also used which absorb UV light and which can be fixed in a special layer by employing a mordant.

One disadvantage of these organic compounds is that they are only stable to a limited extent themselves. If compounds which absorb UV light are decomposed by light, the image dyes start to fade. Another disadvantage of using organic compounds is the migration thereof to the surface of photographic materials when the latter are stored at elevated temperatures and/or under conditions of high atmospheric humidity.

This disadvantage can sometimes be overcome by the use of $TiO_2$ pigments, the average primary particle diameter of which is 5 to 100 nm, preferably 5 to 20 nm. These $TiO_2$ pigments are transparent and exhibit hardly any light-scattering properties by comparison with conventional white pigments based on $TiO_2$ (rutile and anatase) with a particle size of about 0.2 $\mu$m.

Corresponding compounds and the use thereof as UV absorbers in photographic materials are disclosed in EP-A-736 800.

However, UV light absorbers which contain particles of the aforementioned inorganic compounds have the disadvantage that due to an absorption edge which extends over wide portions of the UVA region (320 to 400 nm) and/or due to a relatively small absorption cross-section, high concentrations of particles are necessary in order satisfactorily to absorb light over the entire UVA region. However, the high concentrations of particles which are thereby necessary result in an increased level of haze and involve the risk of the photographic material exhibiting a reduced capacity to withstand mechanical stresses. Moreover, $TiO_2$, which was hitherto the best known particle for the absorption of UV light, has a photocatalytic effect, so that it has to be coated so as not to damage the protective medium by radical formation which is initiated by the particle itself.

The object of the present invention was therefore to provide UV light absorbers which do not have the disadvantages which are known in the prior art and which are particularly suitable for the long-term protection of photographic materials.

It has now been found that this object is achieved by the use of solid particles of cerium(IV) oxide ($CeO_2$), zinc oxide (ZnO) or barium titanate ($BaTiO_3$) with an average diameter <300 nm as UV absorbers in photographic materials.

The present invention therefore relates to a colour photographic recording material comprising at least one light sensitive silver halide emulsion layer and optionally a light insensitive layer which is disposed nearer the source of light than is the light sensitive silver halide emulsion layer, characterised in that at least one of said layers contains particles of cerium(IV) oxide, zinc oxide or barium titanate with an average diameter <300 nm.

The term "average diameter" to be understood as the maximum of the distribution by number. The particles are preferably spherical.

The particles of $CeO_2$, ZnO and $BaTiO_3$ are amorphous or crystalline materials. The size of the particles is between 1 and 300 nm, preferably between 3 and 100 nm, most preferably between 3 and 50 nm. The particles preferably have a size distribution with a maximum half-width value corresponding to 100% of the average particle diameter. ZnO particles are produced, for example, as described in J. Phys. Chem. 91, pages 3789–3798 (1987) or can be obtained from Nyacol Products Inc. $CeO_2$ can be obtained from Aldrich. $BaTiO_3$ can be produced as described in Nanostructured Materials 9, pages 241–244 (1997).

The oxide compounds according to the invention ($CeO_2$, ZnO, $BaTiO_3$) are situated either in the layer in which the dye which is to be protected from UV light is formed, or in a layer which is disposed nearer the source of light than is the aforementioned layer, or they are distributed between the various layers.

The oxide compounds according to the invention are preferably employed in a layer which is disposed nearer the source of light than is the layer which contains dye to be protected.

The oxide compounds according to the invention are normally used in an amount of 0.05 to 30 g/m$^2$of photographic material.

The photographic material preferably contains the oxide compounds according to the invention in an amount of 0.1 to 20 g/m$^2$, most preferably 0.2 to 10 g/m$^2$.

It is particularly advantageous if the oxide compounds according to the invention are dispersed in a gelatine solution and can thus be cast to form a layer. A considerably thinner layer is therefore obtained than with conventional UV absorbers, which are usually distributed in high-boiling organic solvents and which thus have to be emulsified as fine droplets in a gelatine solution.

The oxide compounds according to the invention impart a durable protection from UV light to the dyes of the photographic image which is obtained after colour development, since, as distinct from organic UV absorbers, they are not decomposed by UV light.

The oxide compounds according to the invention can also be used in photographic materials together with prior art UV absorbers and together with particles of elemental silicon and/or solid compounds in which silicon is present in stoichiometric excess, with an average diameter <120 nm.

Examples of preferred organic UV absorbers which can be combined with the compounds according to the invention are described in Research disclosure 37038 (1995) Part X, 37254 (1995) Part 8 and 38957(1996) Part VI, and are also described in DE-A-19 537 291, EP-A-431 868, EP-A-436

464, EP-A-640 591, EP-A-706 083, EP-A-747 755, EP-A-750 224, U.S. Pat. No. 5,362,881 and U.S. Pat. No. 5,455,152.

Examples of colour photographic materials include colour negative films, colour reversal films, colour positive films, colour photographic paper, colour reversal photographic paper, and colour-sensitive materials for the colour diffusion transfer process or the silver halide bleaching process.

Photographic materials consist of a support on which at least one light-sensitive silver halide emulsion layer is deposited. Thin fihns and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

The oxide compounds according to the invention are preferably added to colour photographic print that, namely to colour photographic print and to transparent colour photographic film for display purposes.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

Colour photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layers are binders, the silver halide grains and colour couplers.

Information on suitable binders is given in Research Disclosure 37254, Part 2 (1995), page 286, and in Research Disclosure 38957, Part IIa (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part VA (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part XB (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part XC (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part XD (1996), page 621 et seq.

The photographic material may additionally contain compounds which absorb UV light, brighteners, spacers, filter dyes, formalin scavengers, light stabilisers, antioxidants, $D_{Min}$ dyes, additives for improving the dye-, coupler- and white stability and to reduce colour fogging, plasticisers (latices), biocides and other substances.

Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part IIB (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), page 630 et seq., together with examples of materials.

EXAMPLE

Layer structure 1

A colour photographic recording material was produced by depositing the following layers in the given sequence on a film base comprising paper coated on both sides with polyethylene. The quantitative data are given with respect to 1 $m^2$ in each case. The corresponding amounts of $AgNO_3$ are quoted for silver halide deposition.

Layer 1: (substrate layer)
- 0.10 g gelatine

Layer 2: (blue-sensitive layer)
- A blue-sensitised silver halide emulsion (99.5 mole % chloride, 0.5 mole % bromide, average grain diameter 0.9 μm), comprising 0.46 g $AgNO_3$, with
- 0.70 mg blue stabiliser BS-1
- 0.30 mg stabiliser ST-1
- 1.25 g gelatine
- 0.48 g yellow coupler Y-1
- 0.10 g image stabiliser BST-1
- 0.50 g oil former OF-1

Layer 3: (intermediate layer)
- 1.10 g gelatine
- 0.06 g DOP scavenger EF-1
- 0.06 g DOP scavenger EF-2
- 0.12 g tricresyl phosphate (TCP)

Layer 4: (green-sensitive layer)
- A green-sensitive silver halide emulsion (99.5 mole % chloride, 0.5 mole % bromide, average grain diameter 0.47 μm), comprising 0.26 g $AgNO_3$, with
- 0.70 mg green sensitiser GS- 1
- 0.15 mg stabiliser ST-2
- 0.77 g gelatine
- 0.24 g magenta coupler M-1
- 0.20 g image stabiliser BST-2
- 0.09 g image stabiliser BST-3
- 0.12 g DOP scavenger BF-2
- 0.24 g dibutyl phthalate (DBP)
- 0.24 g isotridecanol (ITD)

Layer 5: (UV protection layer)
- 0.95 g gelatine
- 0.50 g UV absorber UV-1
- 0.03 g DOP scavenger EF-1
- 0.03 g DOP scavenger BF-2
- 0.15 g oil former OF-2
- 0.15 g TCP Layer 6: (red-sensitive layer)
- A red-sensitised silver halide emulsion (99.5 mole % chloride, 0.5 mole % bromide, average grain diameter 0.5 μm), comprising 0.30 g $AgNO_3$, with
- 0.03 mg red sensitiser RS-1
- 0.60 mg stabiliser ST-3
- 1.00 g gelatine
- 0.46 g cyan coupler C-1
- 0.46 g TCP Layer 7: (UV protection layer)
- 0.30 g gelatine
- 0.20 g UV absorber UV-1
- 0.10 g oil former OF-3

Layer 8: (protective layer)
- 0.90 g gelatine
- 0.05 g optical brightener WT-1
- 0.07 g mordant (polyvinylpyrrolidone)
- 1.20 mg silicone oil
- 2.50 mg spacer (polymethyl methacrylate, average particle size 0.8 μm)
- 0.30 g hardener H-1

Compounds used in layer structure 1:

BS-1

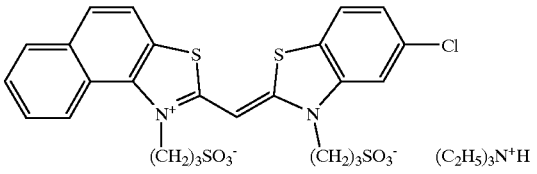

GS-1

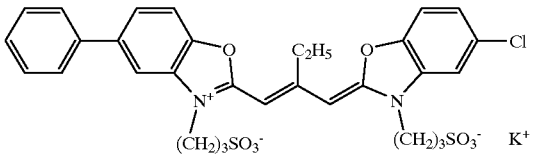

RS-1

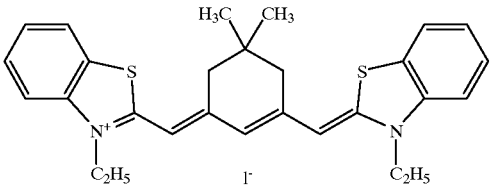

ST-1

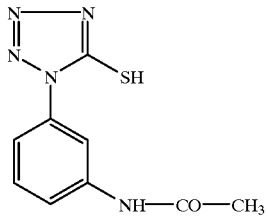

-continued
ST-2
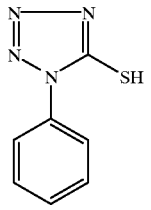
ST-3
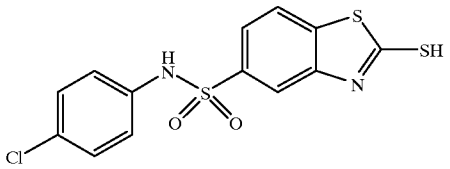
Y-1
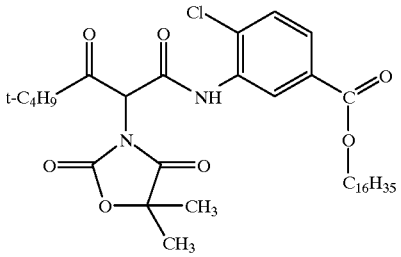
M-1
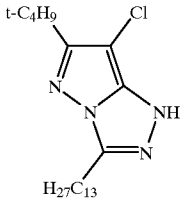
C-1
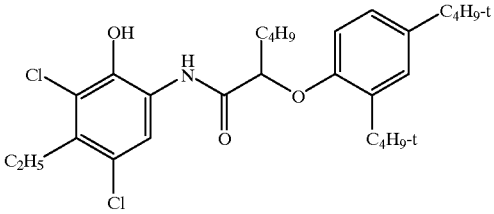
BST-1
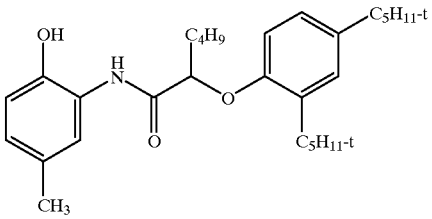
BST-2
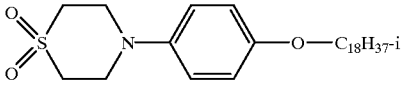
BST-3
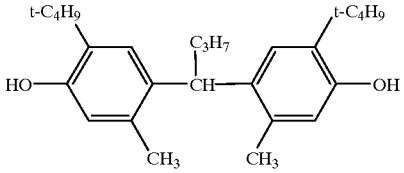
EF-1
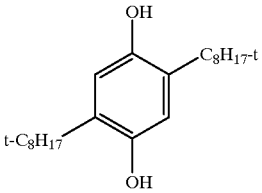
EF-2
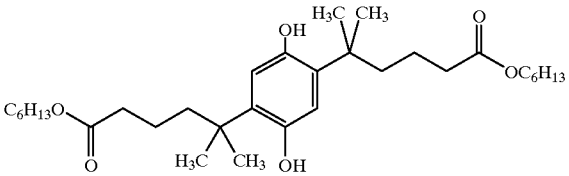
OF-1
A polyester of HOOC—$(CH_2)_4$—COOH, HO—$CH_2$—$C(CH_3)_2$—$CH_2OH$ and $C_{10}H_{21}$-i
η(20° C.): 4000–5000 mPa.s
$n_D$(20° C.): 1.464–1.467
OF-2
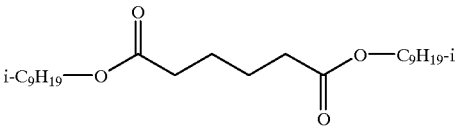
OF-3
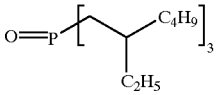

-continued

UV-1

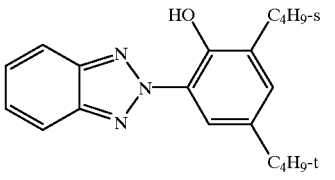

and

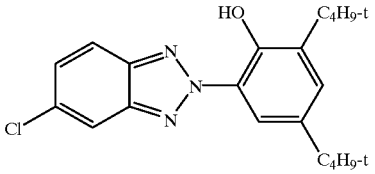

in a ratio by weight of 9:1

WT-1

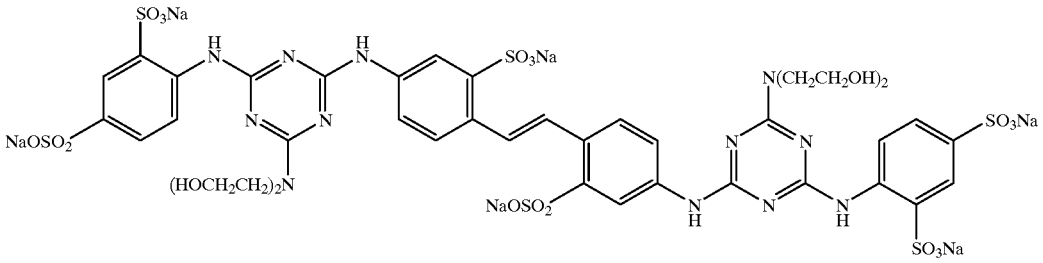

H-1

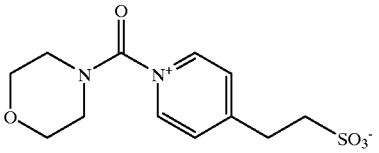

Layer structures 2 and 3

Layers structures 2 and 3 corresponded as regards their layer structure and composition to layer structure 1, and only differed in that UV absorber UV 1 in layers 5 and 7 was replaced by the same amounts of the substances given in Table 1. In addition, oil formers OF-2 or OF-3 were omitted in these layers.

Samples were exposed behind a stepped photometric absorption wedge, wherein colour filters were introduced into the beam path in such a way that a neutral grey was obtained at D=0.7. The subsequent procedure was as follows:

| a) Colour developer - 45 seconds at 35° C. | |
|---|---|
| tetraethylene glycol | 20.0 g |
| N,N-diethylhydroxylamine | 2.0 g |
| N,N-bis-(2-sulphoethyl)hydroxylamine, disodium salt | 2.0 g |
| N-ethyl-N-(2-methanesulphonamidoethyl)-4-amino-3-methylbenzene sulphate | 5.0 g |
| potassium sulphite | 0.2 g |
| potassium carbonate | 30.0 g |
| hydroxyethanediphosphonic acid | 0.2 g |
| polymaleic anhydride | 2.5 g |
| optical brightener (a derivative of 4,4'-diamino-stilbenesulphonic acid) | 2.0 g |
| potassium bromide | 0.02 g |
| made up to 1000 ml with water; | |
| pH adjusted to pH 10.2 with KOH or $H_2SO_4$. | |
| b) Bleach-fixer - 45 seconds - 35° C. | |
| ammonium thiosulphate | 75.0 g |
| sodium hydrogen sulphite | 13.5 g |
| ethylenediaminetetraacetic acid (iron ammonium salt) | 45.0 g |
| made up to 1000 ml with water; | |
| pH adjusted to pH 6.0 with ammonia (25 % by weight) or acetic acid. | |

-continued

| | |
|---|---|
| c) Washing - 90 seconds - 33° C. | |
| d) Drying | |

The samples were subsequently exposed to the light of a xenon lamp normalised to daylight, and the change in colour density and yellow fogging were determined (see Table 1).

The following substances were used as UV absorbers in layers 5 and 7:

UV 2 titanium (IV)oxide ($TiO_2$) in its rutile modification, average primary particle diameter: 10 nm UV 3 cerium(IV) oxide ($CeO_2$), average primary particle diameter: 8 nm UV 4 zinc oxide (ZnO), average primary particle diameter: 10 nm UV 5 barium titanate ($BaTiO_3$), average primary particle diameter: 30 nm As shown in Table 1, UV absorbers UV-3, -4 and -5 according to the invention are superior to comparison compound UV-1 on account of their intrinsic stability to light over long periods of exposure. The UV absorbers according to the invention are superior to comparison compound UV-2, even at short times of irradiation, on account of their higher UV absorption in the long-wave UV region.

TABLE 1

(C: comparison, I: invention)

| Layer structure | UV absorber | Intensity of irradiation [$10^6$ · Lxh] | Δ yellow fogging (%) | Colour density (%) $D_{yl}$ = 0.3 | $D_{mg}$ = 0.3 | $D_{cy}$ = 0.3 |
|---|---|---|---|---|---|---|
| 1 (C) | UV-1 | 15 | +18 | −35 | −40 | −31 |
| | | 30 | +28 | −68 | −71 | −63 |

TABLE 1-continued (C: comparison, I: invention)

| Layer structure | UV absorber | Intensity of irradiation [$10^6 \cdot$ Lxh] | Δ yellow fogging (%) | Colour density (%) $D_{yl}$ = 0.3 | $D_{mg}$ = 0.3 | $D_{cy}$ = 0.3 |
|---|---|---|---|---|---|---|
| 2 (C) | UV-2 | 15 | +27 | −45 | −51 | −40 |
| | | 30 | +33 | −75 | −80 | −72 |
| 3 (I) | UV-3 | 15 | +17 | −35 | −39 | −30 |
| | | 30 | +24 | −60 | −65 | −56 |
| 4 (I) | UV-4 | 15 | +19 | −34 | −39 | −32 |
| | | 30 | +25 | −61 | −64 | −57 |
| 5 (I) | UV-5 | 15 | +18 | −36 | −41 | −31 |
| | | 30 | +24 | −62 | −65 | −57 |

We claim:

1. A color photographic recording material comprising at least one light sensitive silver halide emulsion layer and optionally a light insensitive layer which is disposed nearer the source of light than is the light sensitive silver halide emulsion layer, and at least one of said layers contains particles of cerium(IV) oxide, zinc oxide or barium titanate with an average diameter <300 nm.

2. The color photographic recording material according to claim 1, wherein the particles are spherical.

3. The color photographic recording material according to claim 1, wherein the particles have a size distribution with a maximum half-width value corresponding to 100% of the average particle diameter.

4. The color photographic recording material according to claim 1, wherein said particles have an average diameter of 3 to 100 nm.

5. The color photographic recording material according to claim 1, wherein the particles are contained in the recording material in an amount of 0.05 to 30 g/m$^2$.

6. The color photographic recording material according to claim 1, wherein the material is a color photographic paper or a transparent color photographic film for display purposes.

7. The color photographic recording material according to claim 1, wherein at least one layer contains particles of elemental silicon and/or of solid compounds in which silicon is present in stoichiometric excess, with an average diameter <120 nm.

8. The color photographic recording material according to claim 1, wherein at least one layer contains at least one organic UV absorber.

9. The color photographic recording material according to claim 1, wherein the particle size is from 1 to 300 nm.

10. The color photographic recording material according to claim 8, wherein said particles have an average diameter of 3 to 50 nm.

11. The color photographic recording material according to claim 1, wherein the oxide compound is in an amount of 0.1 to 20 g/m$^2$.

12. The color photographic recording material according to claim 11, wherein the oxide compound is in an amount of 0.2 to 10 g/m$^2$.

13. The color photographic recording material according to claim 1, wherein the material contains chloride-bromide emulsions which contain up to 80 mol % AgBr.

14. The color photographic recording material according to claim 8, wherein the UV absorber is 2-(2-hydroxyphenyl) benztriazole or 2-(2-hydroxyphenyl)-1,3,5-triazine.

* * * * *